United States Patent [19]

Hobbs, Jr. et al.

[11] Patent Number: 4,516,409

[45] Date of Patent: May 14, 1985

[54] PORTABLE BEVERAGE COOLER

[76] Inventors: Andrew G. P. Hobbs, Jr., P.O. Box 240; Brett D. Lickle, "The Yellow House" ; Patricia W. Hobbs, P.O. Box 240, all of Montchanin, Del. 19710

[21] Appl. No.: 605,919

[22] Filed: May 1, 1984

[51] Int. Cl.[3] ..... F25D 3/08

[52] U.S. Cl. ..... 62/457; 62/430; 220/93; 220/902

[58] Field of Search ..... 62/457, 530, 371, 430; 206/804, 817, 430, 428; 220/412, 902, 93

[56] References Cited

U.S. PATENT DOCUMENTS

| | | | |
|---|---|---|---|
| 2,057,933 | 10/1936 | Brinkman | 220/412 |
| 2,065,006 | 12/1936 | Zivanov | 220/412 |
| 2,622,415 | 12/1952 | Landers et al. | 62/430 X |
| 3,161,031 | 12/1964 | Flannery | 62/457 |
| 3,205,678 | 9/1965 | Stoner | 62/457 |
| 3,263,806 | 8/1966 | Ring | 220/902 X |
| 3,703,816 | 11/1972 | Weathers | 62/457 |
| 3,717,282 | 2/1973 | Nordskog | 220/93 X |
| 4,163,374 | 8/1979 | Moore et al. | 62/457 |
| 4,183,226 | 1/1980 | Moore | 62/457 |
| 4,193,525 | 3/1980 | Sommers | 220/902 X |

*Primary Examiner*—Lloyd L. King

*Attorney, Agent, or Firm*—Connolly and Hutz

[57] ABSTRACT

A portable beverage cooler comprises a tubular container having an internal storage passageway therein open at its opposite ends and arranged to receive a plurality of beverage cans in end-to-end relationship. Removable caps at the ends of the container function to close the ends of the storage passageway. The container has generally cylindrical inner and outer side walls slightly spaced apart and together defining a closed refrigeration chamber therebetween with refrigerant in the chamber. A spring in the storage passageway is biased against the beverage cans to assist in removing them from the cooler when one or the other of the end caps is removed.

14 Claims, 9 Drawing Figures

PORTABLE BEVERAGE COOLER

BACKGROUND OF THE INVENTION

The present invention relates to a portable beverage cooler, and more particularly to a convenient cooler wherein beverage cans are arranged in end-to-end relationship.

Prior to the present invention, numerous beverage coolers have been proposed for maintaining canned beverages such as beer and soft drinks at the cold temperatures desired for consumption of these liquids. Many of the heretofore coolers are generally cumbersome and designed to accommodate a large number of beverage cans as well as other foods. Coolers exclusively used for beverage cans also tend to be cumbersome and no adequate provision is made for the empty cans thereby requiring separate storage for the spent cans. Often a beverage cooler is desired for just a few cans and a small cooler is needed for such purposes. On other occasions more than just a few cans must be accommodated and the cooler must adapt to such expanded use. Regardless of how many cans are stored in the cooler, maintaining the beverages cold is of prime importance. Other desirable characteristics include a convenient cooler size together with ease in handling and storing the cooler.

SUMMARY OF THE INVENTION

Accordingly, it is an object of the present invention to provide a portable beverage cooler which functions in an efficient manner to cool canned beverages, the cooler being easy to use and convenient to transport.

Another object of the present invention is a portable beverage cooler that provides storage space for empty beverage cans.

In accordance with the present invention, a portable beverage cooler comprises a tubular container having an internal storage passageway therein open at its opposite ends and arranged to receive a plurality of beverage cans in end-to-end relationship. Removable caps are located at the ends of the containers, for closing the storage passageway. The container has generally cylindrical inner and outer side walls slightly spaced apart and together defining a closed refrigeration chamber therebetween with refrigerant in the chamber. A spring device in the storage passageway is biased against the beverage cans to assist in removing them from the cooler when one or the other of the end caps is removed.

Preferably, the spring device comprises a coil spring having a longitudinal axis in alignment with or parallel to the long axis of the internal storage passageway. The coil spring has a collapsed condition and an expanded condition which runs approximately the length of the storage passageway. Moreover, bearing plates may be attached to the coil spring on opposite sides thereof, each plate constructed and arranged to slide within the internal storage passageway and bear against the beverage cans as such cans are introduced into the cooler and removed therefrom.

The tubular container may comprise a pair of substantially identical container sections each having a capacity for about three beverage cans. The container sections abut one another so that the storage passageways are in alignment, and a releasable connection is utilized to secure the container sections together. Preferably the releasable connection between the container sections is threaded, one container section having male threads at one end thereof and the other section having female threads at the end thereof abutting the first section.

The connection between each end cap and the tubular container is preferably threaded, and a flexible tie is connected between each end cap and the container.

Fixed loops are positioned on the outer side wall of the container and flexible straps extend through the loops for manipulating and securing the cooler. Preferably, the outer side wall of the container includes recessed portions and the fixed loops are located within these portions.

A flexible sleeve may surround the container for ease in handling and insulating the container. The sleeve has removable end covers for access to the container end caps and the storage passageway. Moreover, a waterproof pouch may be secured to the flexible sleeve on the outside thereof. Also, a dry storage cell may be positioned inside the flexible sleeve, if desired.

BRIEF DESCRIPTION OF THE DRAWING

Novel features and advantages of the present invention in addition to those mentioned above will become apparent to those skilled in the art from a reading of the following detailed description in conjunction with the accompanying drawing wherein similar reference characters refer to similar parts and in which.

DETAILED DESCRIPTION OF THE INVENTION

Figure 1:
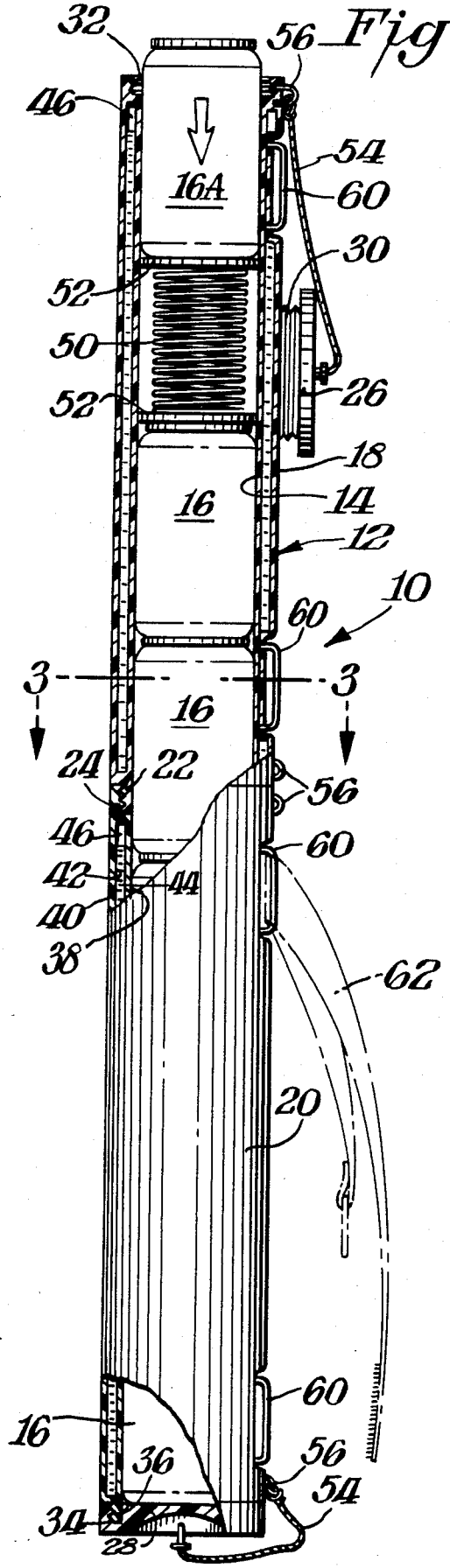
FIG. 1 is a side elevational view of a portable beverage cooler, according to the present invention, with portions broken away to show interior details.
Figure 2:
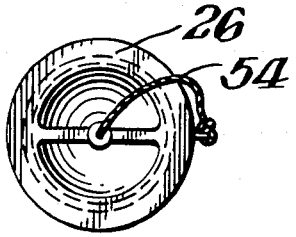
FIG. 2 is a bottom plan view of the portable beverage cooler shown in FIG. 1.
Figure 3:
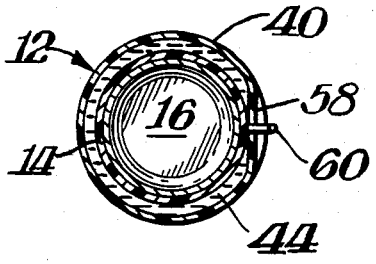
FIG. 3 is a sectional view taken along line 3—3 of FIG. 1.
Figure 4:
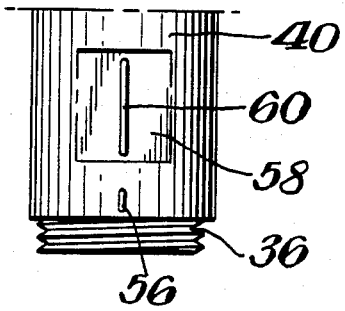
FIG. 4 is a partial rear elevational view of the lower portion of the beverage cooler illustrating a fixed loop and a container recess for the loop.

Referring in more particularity to the drawing, a portable beverage cooler 10 comprises a tubular container 12 having an internal storage passageway 14 open at its opposite ends and arranged to receive a plurality of beverage cans 16 in end-to-end relationship. Such canned beverages may include beer and soft drinks or other liquids. As shown best in FIG. 1, the tubular container 12 comprises a pair of identical container sections 18,20 abutting one another with the storage passageways of each section in alignment. The container sections are releasably secured together by a threaded connection comprising male threads 22 on the lower end of the upper section and female threads 24 at the upper end of the lower section. As explained more fully below, the container sections are stacked one upon the other depending upon the number of beverage cans 16 to be accommodated. On those occasions where only a few cans are carried, one section may be used while two or more sections may be interconnected when additional cans are carried.

The storage passageway 14 is closed at its opposite ends by removable end caps comprising upper cap 26 and lower cap 28. The upper cap has male threads 30 that cooperate with female threads 32 at the upper end of the container for releasably securing cap 26 is place. The lower end cap 28 has female threads 34 that cooperate with male threads 36 at the lower end of the container for releasably securing cap 28 in place.

Each container section 18,20 includes a generally cylindrical inner side wall 38 and an outer side wall 40 slightly spaced apart from inner wall 38 and together defining a closed refrigeration chamber 42 with refrigerant 44 in the chamber. The refrigerant 44 may be any suitable composition preferably a liquid coolant such as propylene glycol, for example. In use, one or more of the container sections is placed in a conventional refrigerator freezer to reduce the temperature of the refrigerant. Also, it is preferred that a small space 46 exist in the refrigeration chamber which allows for expansion of the coolant. Obviously the function of the refrigerant is to maintain the beverage cans 16 cold until removed from the cooler 10 for consumption.

A coil spring 50 positioned in the storage passageway 14 is biased against the beverage cans 16 to assist in removing them from the cooler 10 when one or the other of the end caps 26,28 is removed. Spring 50 expands between a fully collapsed condition and an expa:ded condition, the expanded condition running approximately the length of the internal passageway 14. Bearing plates 52 are attached to coil spring 50 on opposite sides thereof, and each plate is dimensioned to slide within the internal storage passageway 14 and bear against the beverage cans 16 as such cans are introduced into the cooler and removed therefrom. Preferably the bearing plates are circular in configuration having a diameter slightly smaller than the diameter of the passageway 14.

The function of coil spring 50 is to provide an internal biasing force on the beverage cans 16 in the cooler which acts on the cans to expel them from the internal storage passageway. Hence, when one of the end caps is released from the container, one or more of the beverage cans 16 is easily removed from the cold storage passageway. As the cans are so removed, the coil spring is expanded to a position where it functions to remove the remaining cans when desired. Alternatively, empty cans such as 16A may be introduced into the top of the tubular container while full cans are removed from the bottom thereof. Under these circumstances the coil spring does not expand as much as it does when cans are only removed from the cooler and no empties inserted into the upper end.

A flexible tie 54 may be connected between each end cap 26,28 and an eyelet 56 on the outside surface 40 of the container 12 comprising the upper and lower sections 18,20. Also, outside surface 40 of container 12 may include upper and lower recesses 58 in each section 18,20. Longitudinally disposed loops 60 are fixed to the outer surface of the tubular container at the recesses 58, and flexible straps 62 may extend through one or more of the loops 60 for manipulating and securing the cooler 10.

Figure 5:
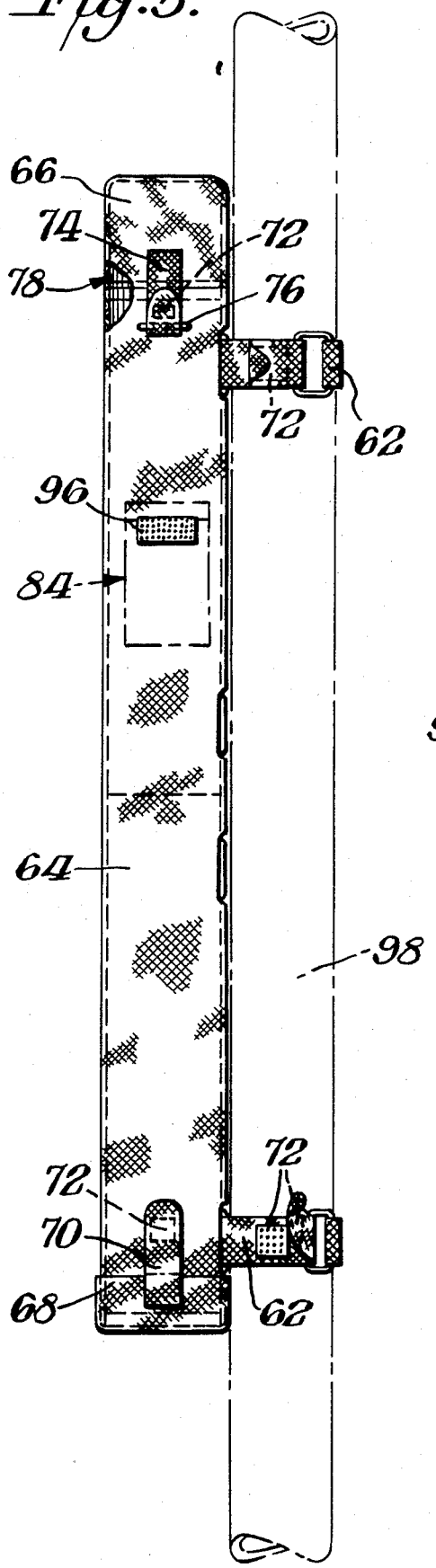
FIG. 5 is an elevational view similar to FIG. 1 with a flexible sleeve surrounding the beverage cooler and straps securing the cooler to a mast.
Figure 6:
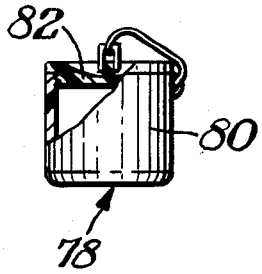
FIG. 6 is a side elevational view of a dry storage cell, according to the present invention, with portions broken away to show interior details.
Figure 8:
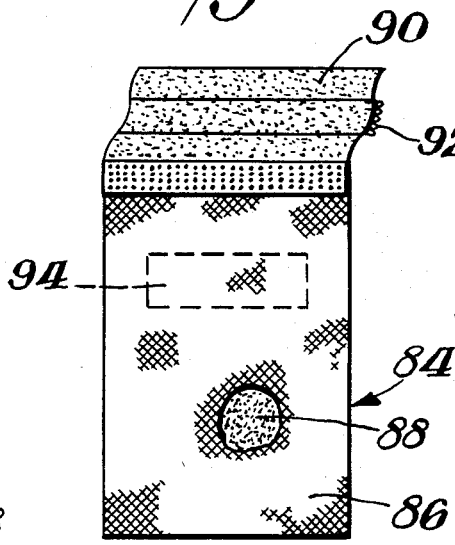
FIG. 8 is a diagrammatic view of a waterproof pouch for securement to the exterior of the flexible sleeve.
Figure 9:
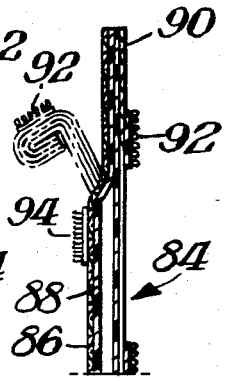
FIG. 9 is a sectional view illustrating the open end of the pouch in its sealed condition.
Figure 7:
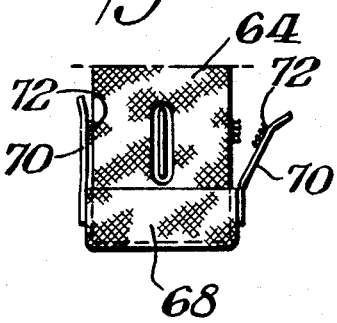
FIG. 7 is a rear elevational view of the lower portion of the flexible sleeve illustrating the lower removable end cover of the sleeve.

As shown best in FIG. 5, a flexible sleeve 64 may surround the container 12, the flexible sleeve including a removable upper end cover 66 and a similarly fabricated removable lower end cover 68 for providing access to the container end caps and the storage passageway when the flexible sleeve is used. Referring to FIG. 7, the lower end cover 68 has opposite side straps 70 with a velcro-type fastener 72 between the inside of the straps and the outside of the flexible sleeve. Upper removable end cover 66 is similarly fashioned and includes side straps 74 which extend through loops 76 on the outside of the sleeve. A velcro-type fastener 72 is located on each strap 74 to secure the strap in place after it is folded over loop 76. Removable end cover 66 has a slightly larger body portion for accommodating a dry storage cell 78, shown best in FIG. 6.

Dry storage cell 78 includes a cup shaped body 80 with a releasable cap 82 thereon having the same dimensions as end cap 26. Storage cell 78 is located within the end cover 66 and secured to the container 12 when the straps 74 are fastened in place.

Another feature of the present invention is a waterproof pouch 84 having a fabric exterior 86 and a waterproof liner 88 fabricated from natural or synthetic rubberlike material. In use the pouch is sealed by a plurality of folds 90 at the upper end thereof with an appropriate velcro-type fastener 92 employed to hold the folds together. Velcro-type material 94 on the outside of the waterproof pouch cooperates with velcro-type material 96 on sleeve 64 to releasably secure the pouch to the sleeve.

The container sections 18,20 along with end caps 26,28 and the dry storage cell 78 may be fabricated of thermoplastic materials by techniques known in the art. Other materials are also equally suitable. After fabrication, the refrigeration chamber 42 in each section is filled with suitable refrigerant 44 and sealed. The fabric material of the sleeve 64 may be any durable material preferably having some insulating properties.

As noted above, one or more of the container sections may be used to carry the beverage cans. Prior to such use the sections are placed in a conventional refrigerator freezer to reduce the temperature of the refrigerant. Assuming two sections are used, the sections are interconnected and chilled cans 16 loaded into the internal storage passageway 14. After the passageway is filled with the desired number of cans, coil spring 50 and its associated end plates 52 are placed in the passageway and both end caps are secured in place. A cold can is removed by simply removing the lower end cap 28 from tubular container 12 whereupon coil spring 50 functions to urge the can out of the passageway. This procedure is repeated when other cans are removed. As shown best in FIG. 1, empty cans 16A may be introduced into the upper end of the passageway 14 for storage of the spent cans.

When the fabric sleeve is used, the dry storage cell 78 and waterproof pouch 84 may be associated with the tubular beverage container 12. As shown best in FIG. 5, the container, with or without its fabric sleeve, may be secured to a mast 98 by the strap 62. Such straps also function to manipulate the beverage cooler 10 and fasten it in place at other locations.

What is claimed is:

1. A portable beverage cooler comprising a tubular container having an internal storage passageway therein open at its opposite ends and arranged to receive a plurality of beverage cans in end-to-end relationship, removable caps at the ends of the container closing the ends of the storage passageway, spring means in the storage passageway biased against beverage cans to assist in removing them from the cooler when one or the other of the end caps is removed and bearing means on opposite ends of the spring means constructed and arranged to engage beverage cans as such cans are introduced into the cooler and removed therefrom.

2. A portable beverage cooler as in claim 1 wherein the spring means comprises a coil spring having a longitudinal axis in alignment with or parallel to the long axis of the internal storage passageway, the spring means having a collapsed condition and expanded condition, the expanded condition running approximately the length of the internal storage passageway.

3. A portable beverage cooler as in claim 1 wherein the container includes cylindrical inner and outer side walls slightly spaced apart and together defining a closed refrigeration chamber therebetween and refrigerant in the chamber.

4. A portable beverage cooler as in claim 1 wherein the bearing means includes bearing plates attached to the spring means on opposite ends thereof, each plate constructed and arranged to slide within the internal storage passageway and bear against beverage cans as such cans are introduced into the cooler and removed therefrom.

5. A portable beverage cooler as in claim 3 wherein the tubular container comprises a pair of substantially identical container sections abutting one another with the internal storage passageway in alignment, and a releasable connection between the container sections.

6. A portable beverage cooler as in claim 5 wherein the connection between the container sections is threaded, one container section having male threads at one end thereof and the other container section having female threads at the end thereof abutting the first section.

7. A portable beverage cooler as in claim 3 wherein the connection between each end cap and the tubular container is threaded.

8. A portable beverage cooler as in claim 3 including a flexible tie connected between each end cap and the tubular container.

9. A portable beverage cooler as in claim 3 including fixed loops on the outer side wall of the tubular container and flexible straps extending through the loops for manipulating and securing the cooler.

10. A portable beverage cooler as in claim 9 wherein the outer side wall of the tubular container includes recessed portions and the fixed loops are located within these portions.

11. A portable beverage cooler as in claim 3 in combination with a flexible sleeve surrounding the tubular container, the sleeve having removable end covers for access to the container end caps and the internal storage passageway.

12. A portable beverage cooler as in claim 11 including a waterproof pouch secured to the flexible sleeve on the outside thereof.

13. A portable beverage cooler as in claim 11 including a dry storage cell inside the flexible sleeve.

14. A portable beverage cooler as in claim 11 including fixed loops on the outer side wall of the tubular container, flexible straps extending through the loops for manipulating and securing the cooler, and openings in the flexible sleeve through which the flexible straps extend.

* * * * *